United States Patent [19]

Schmedemann

[11] 4,128,274

[45] Dec. 5, 1978

[54] ADJUSTING DEVICE FOR A SECTION OF A MEDICAL TREATMENT APPARATUS OR EXAMINING APPARATUS

[75] Inventor: Walter Schmedemann, Hamburg, Fed. Rep. of Germany

[73] Assignee: U.S. Philips Corporation, New York, N.Y.

[21] Appl. No.: 771,466

[22] Filed: Feb. 24, 1977

[30] Foreign Application Priority Data

Mar. 5, 1976 [DE] Fed. Rep. of Germany ..... 2609117

[51] Int. Cl.[2] ..... A47C 1/10

[52] U.S. Cl. ..... 297/410; 108/146; 248/410; 248/411; 248/412; 297/391

[58] Field of Search ..... 108/146, 148; 248/161, 248/410–414; 297/338, 345, 391, 406, 410

[56] References Cited

U.S. PATENT DOCUMENTS

| | | | |
|---|---|---|---|
| 153,014 | 7/1874 | Bamseyer | 108/148 |
| 376,016 | 1/1888 | Stuck | 248/412 |
| 848,991 | 4/1967 | Harvey | 108/148 |
| 1,859,223 | 5/1932 | Stevenson | 248/412 |
| 2,392,477 | 1/1946 | Holm | 108/146 |
| 3,715,997 | 2/1973 | Barth | 248/412 X |
| 3,730,589 | 5/1973 | Lane | 297/391 |
| 3,735,136 | 6/1973 | Snurr | 297/345 X |

*Primary Examiner*—James C. Mitchell
*Attorney, Agent, or Firm*—Jack E. Haken

[57] ABSTRACT

A clamping device for medical apparatus includes a clamping member which act under the influence of spring bias force to permit upward displacement of the apparatus with minimal force and downward displacement of the apparatus when a predetermined applied force is exceeded. One handed adjustment of the apparatus position is thus enabled.

10 Claims, 6 Drawing Figures

Figure 1:
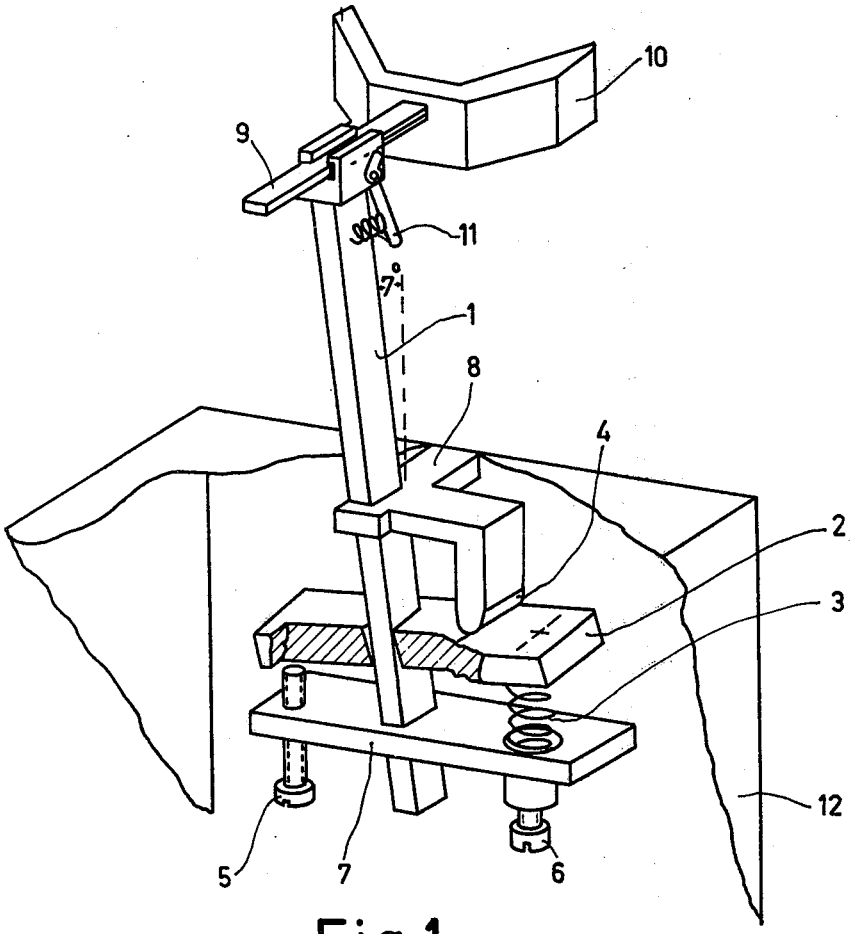

ADJUSTING DEVICE FOR A SECTION OF A MEDICAL TREATMENT APPARATUS OR EXAMINING APPARATUS

The invention relates to an adjusting device for a section of a medical treatment apparatus or examining apparatus, which comprises an approximately vertical rail and a clamping device, the rail and the fixing device being movable relative to each other in the longitudinal direction of the rail, but also being lockable relative to each other. Either the rail or the clamping device may be stationary in space, the section of the apparatus being connected to the other, movable part.

Adjusting devices of this kind can be used where a comparatively light section of apparatus is moved from a first position to a second position in a vertical or substantially vertical direction and where it is necessary to maintain the position then occupied: for example, for vertical adjustment of a head rest of a patient chair or for vertical adjustment of an X-ray source in dentistry.

Adjusting devices of this kind are known: for example, adjusting devices are known for head rests which are connected to a vertical guide rail and which can be secured by friction or by means of clamping screws or eccentrics, in a position necessary for treatment or examination. If the clamping device is subsequently released without the head rest being at the same time suitably supported it will drop. Consequently, for proper manipulation one hand is always required for operating the clamping device and one hand for supporting and sliding the head rest to a desired position. Moreover, it may occur that the clamping screw or the eccentrics are not tightened enough after adjustment so that the head rest yields under the slightest load exerted by the patient.

A distinction can be made between adjusting devices where the apparatus is attached to the rail and the clamping device is rigidly mounted, and adjusting devices where the apparatus is attached to the clamping device while the rail is rigidly mounted. Thus, the apparatus is always connected to the movable part, while the other, rigid part serves to guide the movable part.

The invention has for its object to provide an adjusting device of the kind set forth which enables easy adjustment of the apparatus with only one hand, while accidental shifting is substantially precluded. To this end, a device in accordance with the invention comprises a movable clamping member which is connected to a clamping device and whose movement in the vertical direction relative to the fixing device is limited, the said clamping member being pressed against a rail by spring force which is proportioned so that the clamping member, the clamping device and the rail do not shift relative to each other under the influence of the weight of the apparatus, the clamping member being arranged or shaped so that in the frictional force between the clamping member and the rail decreases in the case of upward movement of the apparatus, while downward movement is possible when a given downward force exerted on the apparatus is exceeded.

Thus, the clamping element has a given play within the fixing device and is shaped or arranged so that in the rest condition (apparatus not loaded) it occupies an angular position in which the friction between the clamping member and the rail is high, while in the case of upward movement of the apparatus the clamping member occupies a position in which the friction between the rail and the clamping member becomes smaller or disappears.

The adjusting device in accordance with the invention thus comprises a brake whose force may be adjustable and which retains the apparatus against the force of gravity, but which yields when a predetermined or adjusted force value is exceeded, the braking force thereof disappearing or being reduced to a fraction of its highest value in the case of movement against the direction of the force of gravity. In a further embodiment of the invention which is particularly suitable for head rests of patient examining chairs and treatment chairs, the apparatus may also be adjusted in the horizontal direction by means of only one hand.

The invention will be described in detail hereinafter with reference to the drawings.

Figure 2:
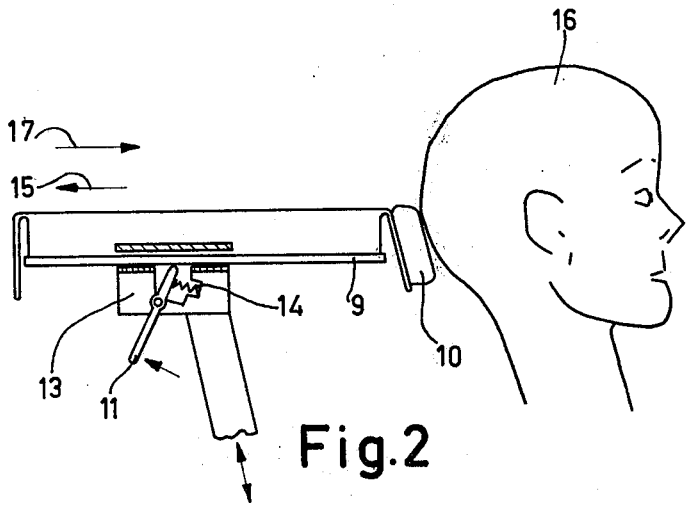

FIG. 1 shows a preferred embodiment of an adjusting device for shifting a head rest, FIG. 2 shows the upper portion of such an adjusting device, and FIGS. 3 to 6 show the clamping member and the fixing device of various other embodiments.

FIG. 1 shows an arced head rest 10 which is secured on a rail 1 having a rectangular cross-section. The rail 1 is slidably guided at an angle of approximately 7° relative to the vertical through corresponding openings in an upper guide piece 8 and a lower guide piece 7. Between the upper and the lower guide pieces there is arranged a lever 2 which engages around the rail 1 and which is tiltable relative to the rail. Tilting of the lever is effected by means of a spring 3 which bears on the lower guide piece 7 and which presses one end of the lever 2 upwards against a stop 4 which is connected to the upper guide piece 8. The guide piece 7 is rigidly connected to a housing 12 which is disposed behind a patient chair (not shown). A screw 6 which engages a thread in the lower guide piece 7 and the upper end of which engages the lower end of the spring 3 enables adjustment of the bias of the spring 3 to the wishes of the user (alternately, the screw can be connected to the lever 2 and the spring 3 may be disposed between the guide piece 7 and the screw end). A screw 5 which is disposed on the lower guide piece 7 and which can be adjusted upwards or downwards forms an abutment which limits the downward movement of the opposite end of the lever 2. In comparison with the parts 1 and 10, the parts 2 thru 8 are actually substantially smaller than illustrated in FIG. 1.

When the product of the friction coefficient between the lever 2 and the rail 1 and the distance between the point at which the spring 3 acts on the lever and the rail is sufficiently large, and if the force which the spring exerts against the end of the lever 2 at least equals the downward force exerted by the weight of the head rest 10 and rail in the direction of the rail, the rail is clamped by the lever 2 which is pressed against the stop 4.

When the user wishes to adjust the head rest 10 to a lower position, he merely has to push down the head rest or the rail 1 with a force which is larger than the difference between the spring force and the force acting on the rail in the downward direction of the rail. This difference can be adjusted by means of the screw 6 which determines the bias of the spring 3. When this difference force is overcome by the user, the rail 1 together with the lever 2, first slides down, against the force of the spring 3, the spring then being further compressed so that resistance against the force exerted by the user initially increases slightly. When the other end of the lever reaches the upper end of the abutment formed by the screw 5, the moment which tilts the lever 2 relative to the rail 1 is reduced until the connection between these two parts, realized by the friction between the lever 2 and the rail 1 is interrupted and the rail can be moved further downwards through the lever.

When the desired position is reached, the user releases the head rest. As a result, the lever 2 is pressed upwards against the stop 4, the other end of the lever then being removed from the abutment 5 and the rail 1 being clamped against the lever 2. In order to minimize shifting of the lever 2 when it is released, it is advisable to arrange the lower abutment 5 so that the distance between the abutment and the other end of the lever is small when the one end of the lever presses against the upper stop 4.

When the user wishes to adjust the head rest to a higher position, it must be pulled upwards. The tilting of the lever 2 is then reduced and the clamping action is removed, so that the user must mainly overcome only the force of gravity acting on the head rest and the rail. The forces required for overcoming the clamping may be small if the upper stop 4 is arranged between the point at which the spring 3 acts on the one end of the lever and the rail, but as near to the point of application as possible.

In many cases it is necessary to displace the head rest not only in the vertical direction, but also in the horizontal direction. The adjusting device required for this purpose is shown in FIG. 2. Therein, the head rest 10 is mounted on a horizontal rail 9 which is horizontally guided in a guide 13. An arm 11, which is pivotable about a shaft which is connected to the guide 13 and which is also perpendicular relative to the horizontal rail, is pressed against the horizontal rail by means of a spring 14, so that, in this condition, the horizontal rail, and hence the head rest, cannot be shifted in the direction of the arrow 15. The force exerted on the head rest by the head of the patient 16 is mainly active in this direction. In order to obtain adjustment in this direction, the arm 11 may be released against the force of the spring 14 and the head rest 10 may be slid in the direction of the arrow 15. However, in the opposite direction, denoted by the arrow 17, adjustment is possible without releasing the arm 11.

If the arm 11 is released and the head rest is slid completely to the left prior to the start of an examination, the user can subsequently adjust the head rest to the right and/or upwards or downwards by means of only one hand.

Figure 3:
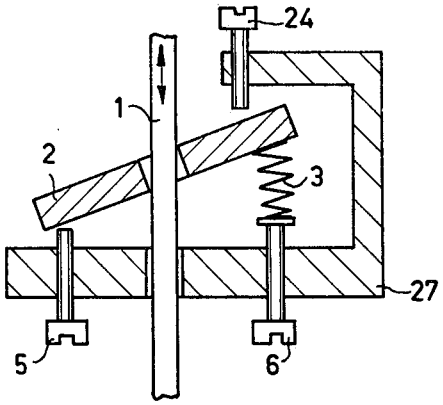

FIG. 3 shows an embodiment in which the clamping device comprises a portion 27 having an approximately U-shaped profile in which a cutout for the rail 1 is provided. The lever 2 is tilted by a spring 3 which is arranged between the one end of the lever 2 and the end of a screw 6 which is screwed into the clamping device 27. A stop is again provided in the form of a screw 5 in the fixing device. When this screw touches the other end of the lever 2, it cancels or reduces the moment applied by the spring 3. The upper stop, in the form of a screw 24, is also connected to the fixing device 27.

Figure 4:
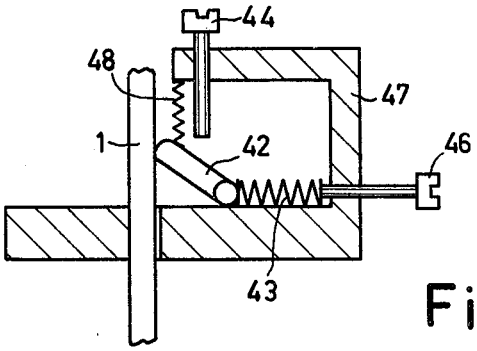

FIG. 4 shows an embodiment in which a clamping device 47 has substantially the same shape as the fixing device 27 of FIG. 3. A clamping member is formed by a one-armed lever 42, one end of which is pressed against the rail 1 while the other end is connected to a spring 43, the force of which can be adjusted by means of a screw 46. A comparatively weak spring 48 ensures that the clamping member cannot easily move in the upward direction. The line of application of the force exerted by the lever 42 on the rail 1 encloses an angle (with the perpendicular to the rail) which is smaller than the friction angle, and a stop (a screw 44 which is adjustable within the fixing device 47) prevents this angle from becoming larger than the friction angle when the lever is displaced upwards.

In the rest condition, when only the weight of the apparatus section acts on the rail 1, the rail is kept in place by the frictional force exerted by the lever. When the section, and hence the rail, is moved downwards, the lever 42 also moves downwards until it is retained in the horizontal position by the fixing device 47. The frictional forces then increase. Simultaneously, the right end of the lever is deflected to the right against the force of the spring 43. When the force exerted on the section is then further increased, the rail 1 slides downwards beyond the end of the lever 42. When the section or the rail 1 is moved upwards, the left end of the lever is first taken in the upward direction until the screw 44 limits further displacement of the lever. The frictional force then decreases until the stop 44 limits the movement along in the upwards direction. Thus, when the section is released after an upwards movement, the rail and the section do not slide further and the braking action is maintained.

Figure 5:
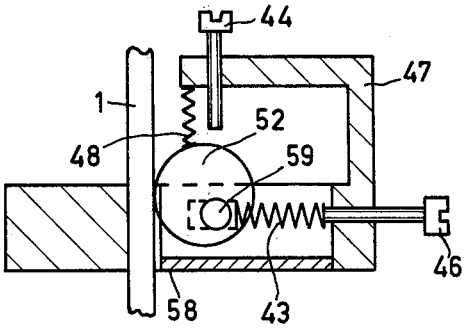

The operation of the embodiment shown in FIG. 5 substantially corresponds to that of the embodiment shown in FIG. 4, except that instead of a one-armed lever use is made of an eccentric 52 which is pivotable about a horizontally guided shaft 59 subject to the force exerted by the spring 43. In the case of downward displacement of the section, the frictional force between the rail and the eccentric 52 again increases initially, the shaft 59 being deflected to the right. A stop 58 prevents the eccentric 52 from being displaced downwards beyond the position in which the shaft 59 occupies its extreme right position.

Figure 6:
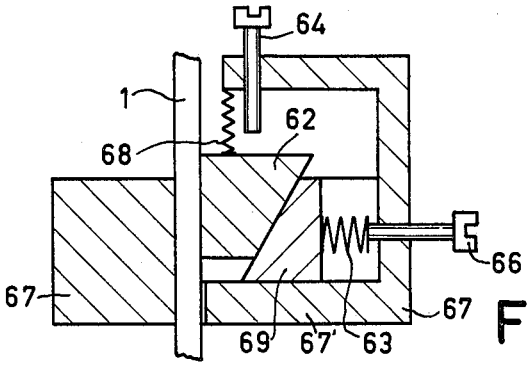

In the embodiment shown in FIG. 6, a tapered wedge 62 is used for the clamping member. Wedge 62 is pressed against the rail 1 by a pressure piece 69 a spring 63 which is arranged between this pressure piece and an adjustable screw 66. The lower stop is formed by a lower horizontal leg of a fixing device 67. During the downward movement, the wedge 62 moves in the downward direction, the wedge-shaped pressure piece 69 simultaneously being moved to the right. At a given force exerted on the apparatus, which can be adjusted by means of the screw 66, the rail 1 is moved downwards beyond the wedge 62. During upwards movement, the wedge 62, which is prevented from being deflected upwards in the rest condition by a weak spring 64, is first carried in the upward direction, the friction between the wedge and the rail then being reduced until the stop 64 prevents further displacement of the wedge 62.

In each of the embodiments of an adjusting device in accordance with the invention which are shown in the FIGS. 1 to 6, the apparatus is secured to a movable rail 1, while the clamping device is arranged to be stationary. As has already been stated, however, the rail 1 can alternatively be arranged to be stationary while the clamping device is movable along this rail. In this case the apparatus must be secured on the clamping device. The embodiments shown in FIGS. 3 to 6 can be readily used for this purpose. This operating position is obtained when the FIGS. rotated through 180°. For example, for the adjusting device shown in FIG. 3, the weight of the section connected to the clamping device 27 bears on the spring 3, which in turn bears on the lever 2 which is tilted with respect to the rail 1. When the pressure on the section is then increased, the spring 3 is further compressed, until the stop 5 is pressed against the right end of the lever 2, the tilting of the lever 2 and the friction between this lever and the rail then being reduced.

What is claimed is:

1. An adjusting device for medical apparatus, comprising an approximately vertical rail structure and a clamping structure, the rail and the clamping structure being movable, relative to each other, in the longitudinal direction of the rail, the apparatus being connected to one of said relatively movable structures the other of said relatively movable structures being stationary in space, comprising:

a movable clamping member which is connected to the clamping structure and whose movement, in the vertical direction, relative to the clamping structure is limited; and spring means which function to bias the clamping member against the rail to produce a frictional force therebetween, the magnitude of said force being proportioned to prevent relative movement of said rail with respect to said clamping structure in response to the weight of said apparatus but to permit said relative movement when at least a predetermined downward force is exerted on said apparatus and to decrease the magnitude of said frictional force in response to upward motion of said apparatus.

2. An adjusting device as claimed in claim 1, wherein:

the clamping member comprises a lever which engages around the rail and which is tiltable with repect thereto; and the spring means comprise a first spring disposed between a first end of the lever and the clamping structure and pressing on said first end of the lever and a first abutment disposed on the clamping structure which limits the movement of a second end of the lever in the case of downward movement of the apparatus.

3. An adjusting device as claimed in claim 2, wherein said spring means further comprise:

a second abutment disposed on the clamping structure which acts on the lever, against the force of the first spring, at a point between the point at which the first spring acts on the lever and the rail so that the said lever remains in a tilting direction during upward movement of the apparatus.

4. An adjusting device as claimed in claim 1, wherein:

the spring means force a first end of the clamping member against a surface of the rail along a line of action which forms an angle, relative to a normal to said surface, which is smaller than the friction angle;

said clamping member is pivotable about a second end;

said clamping structure further comprises means for restricting motion of said second end of said clamping member to a direction approximately perpendicular to said surface; and said spring means further comprise a first spring disposed between said second end of said clamping member and said clamping structure which forces said second end toward said surface.

5. An adjusting device as claimed in claim 4, further comprising an abutment disposed on said clamping structure which functions to limit displacement of said first end of said clamping member.

6. An adjusting device as claimed in claim 4, wherein said spring means further comprise a second spring which is weaker than said first spring and which forces said first end of said clamping member against said surface.

7. An adjusting device as claimed in claim 1, wherein the spring means comprise:

a pressure piece tapered in the upward direction and slidably disposed in said clamping structure and a spring disposed between the clamping structure and the pressure piece which forces the pressure piece toward the rail;

and wherein the clamping member comprises a wedge, tapered in the downward direction, disposed between the pressure piece and the rail.

8. An adjusting device as claimed in claim 1, further comprising:

a slide on the rail structure in which a further rail, which supports the apparatus, is guided approximately horizontally; and wherein one end of an arm is pivotable about a shaft which is approximately perpendicular to the direction of the further rail and is pressed against the further rail by the force of a spring.

9. An adjusting device as claimed in claim 4, wherein the clamping member is a lever.

10. An adjusting device as claimed in claim 4, wherein the clamping member is an eccentric.

* * * * *